United States Patent [19]

Brackett

[11] 4,061,069

[45] Dec. 6, 1977

[54] CHORD LOCATER FOR FRETTED MUSICAL INSTRUMENT

[76] Inventor: Art H. Brackett, 404 E. Walnut, Griggsville, Ill. 62340

[21] Appl. No.: 731,909

[22] Filed: Oct. 13, 1976

[51] Int. Cl.[2] ..... G10D 3/08

[52] U.S. Cl. ..... 84/315

[58] Field of Search ..... 84/315–317

[56] References Cited

U.S. PATENT DOCUMENTS

| | | | |
|---|---|---|---|
| 225,997 | 3/1880 | Percival | 84/315 |
| 1,374,388 | 4/1921 | Reed | 84/315 |
| 1,785,311 | 12/1930 | Johnson | 84/317 |
| 3,995,523 | 12/1976 | Clarke | 84/317 |

*Primary Examiner*—Lawrence R. Franklin

[57] ABSTRACT

A device mounted on the fretboard of a stringed musical instrument for quickly locating and playing simple and complex chords. The device includes a keyboard having a plurality of reciprocable buttons arranged in adjacent rows along the frets overlying the strings of the instrument and longitudinally extending reciprocable keys in contact with a button in adjacent rows. Depression of individual buttons and keys with the fingers enables different simple and compound chords to be quickly located and played on the instrument by contact of shafts on the depressed buttons with the strings at different individual and combined locations on the fretboard.

7 Claims, 3 Drawing Figures

CHORD LOCATER FOR FRETTED MUSICAL INSTRUMENT

BACKGROUND OF THE INVENTION

This invention relates to a fretted, stringed, musical instrument, and more particularly, to a device adapted to be mounted on the fretboard of the instrument for facilitating the location of simple and complex chords on the fretboard.

There are virtually an unlimited amount of chords on a stringed and fretted musical instrument, such as a guitar. Musicians, especially new students have difficulty in remembering not only the specific notes which constitute a particular chord, but have especial difficulty in locating the particular notes of the chord on the fretboard. Although most chords contain only three or four notes, each of these notes recur several times on the fretboard, and can be obtained by pressing one finger on a plurality of locations on any of a plurality of strings on the fretboard, either individiually or simultaneously. This invention provides a device mounted on the fretboard for facilitating the location and playing of the chords on the instrument.

SUMMARY OF THE INVENTION

In accordance with the invention, a keyboard is mounted on the neck or fretboard of the instrument and extends substantially the entire length of the fretboard. The keyboard is hollow and includes a plurality of spring-loaded buttons having a U-shaped groove positioned over the strings on the fretboard at each fret. Depressing of one or more buttons with the fingers enables a chord to be quickly and visually located and played on the strings of the instrument. Longitudinally extending keys are provided between the buttons over adjacent frets so that combinations of notes giving rise to complex chords may be simultaneously played. The use of the buttons and keys also will preclude the development of callouses on the fingers.

BRIEF DESCRIPTION OF THE DRAWING

Further objects and advantages of the invention will become apparent from the following description and claims, and from the accompanying drawings, wherein:

DETAILED DESCRIPTION OF THE PREFERRED EMBODIMENT

Figure 1:
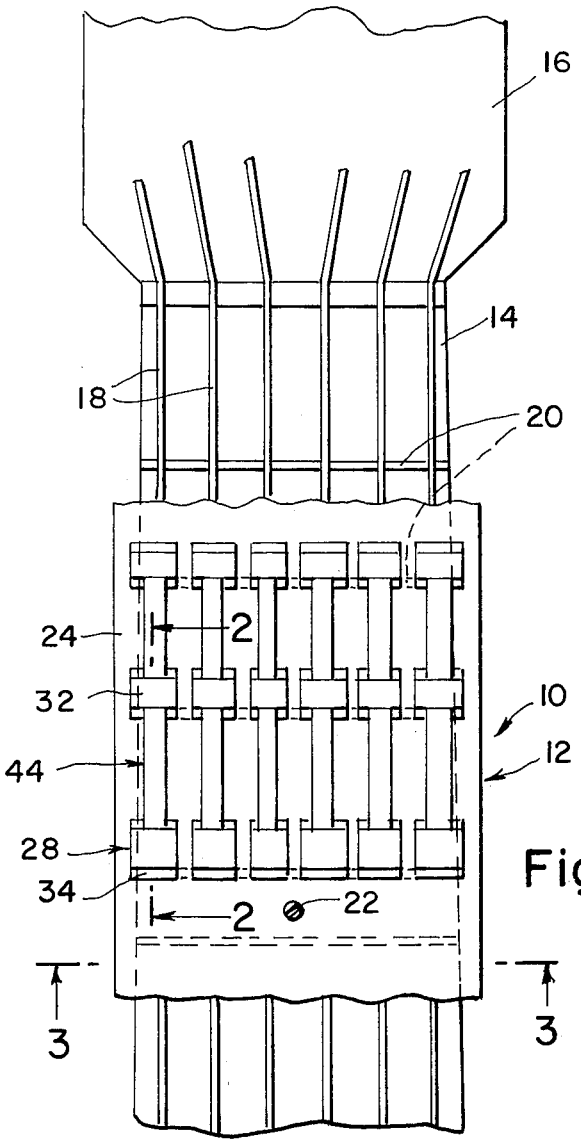
FIG. 1 is a top plan view of the neck of a musical instrument, such as a guitar, provided with a chord locater of the present invention.

Referring now to the drawing in detail, wherein like numerals indicate like elements throughout the several views, the chord locater 10 of the present invention includes a keyboard 12 mounted on the neck or fretboard 14 of a musical instrument 16, such as a guitar, having a plurality of strings 18 and spaced frets 20. Keyboard 12 is mounted on fretboard 14 by threaded fasteners, such as screws 22 so as to extend substantially the entire length of the fretboard 14.

Keyboard 12 is hollow having an upper and lower planar surface 24, 26, mounting rows of buttons 28 in openings 30 in the upper and lower surfaces 24, 26 over each of the strings 18 adjacent each of the frets 20. Each of the buttons 28 includes a substantially rectangular head 32 having shoulders 34 cut along the opposite edges thereof in a longitudinal direction. The head 32 of each button 28 has a depending shaft 36 integrally connected thereto extending through each opening 30 in keyboard 12. The terminal end of shaft 36 includes a V-shaped groove 38 straddling a string 18.

Surrounding each shaft 36 between head 32 and lower planar surface 26 is a coil spring 40 reciprocably supporting each button 28 in aligned holes 30. A pin 42 extends through shaft 36 in a direction perpendicular to the longitudinal axis of shaft 36 below lower surface 26 to restrain upward movement of each button 28 after depression.

Longitudinally extending bar keys 44 having a depending shaft 46 disposed through a pair of aligned holes 30 in the upper and lower planar surfaces 24, 26 has opposite ends supported on the shoulders 34 of adjacent buttons 28. When a bar key 44 is depressed by a finger, the adjacent buttons 28 in contact therewith will also be depressed.

Figure 2:
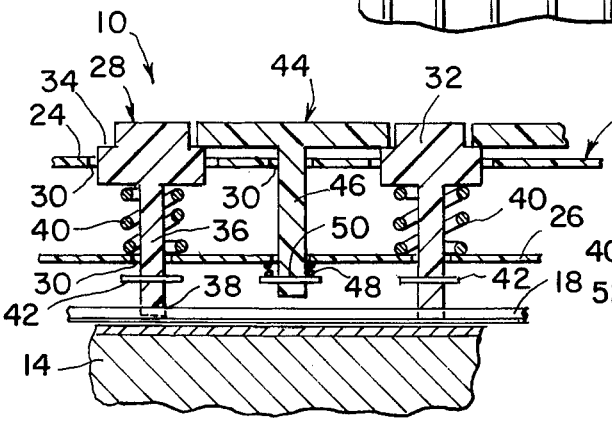
FIG. 2 is a cross-sectional view taken substantially along the plane indicated by line 2—2 of FIG. 1.
Figure 3:
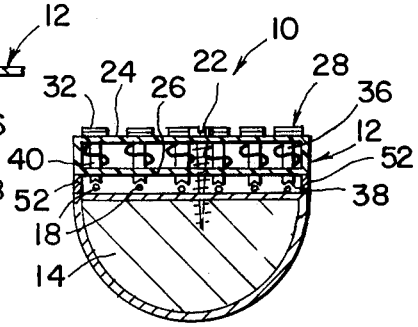
FIG. 3 is a cross-sectional view taken substantially along the plane indicated by line 3—3 of FIG. 1.

As shown in FIG. 2, shaft 46 is also reciprocably mounted in holes 30 by a coil spring 48 held captive between a pin 50 extending perpendicular to the longitudinal axis of shaft 46 below surface 26 and surface 24. Shaft 46 is shorter than button shafts 36. The edges of keyboard 12 are mounted on longitudinally extending spacers 52 between surface 26 and fretboard 14 so the ends of shafts 36 are a sufficient distance above the strings 18.

In use, depression of one or more buttons 28 with the fingers enables a chord to be quickly and visually located and played on fretboard 14, as the shaft 36 will contact string 18 at the precise location on the fretboard 14 required to play the chord. Depression of one or more bar keys 44 will enable two or more button shafts 36 to contact the strings 18 to play a more complex chord. Springs 36 and 48 enable the buttons 28 and bar keys 44 to quickly return to their initial position after depression.

While a specific embodiment of a chord locater for a fretted musical instrument has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A chord locater adapted to be mounted on the neck of a stringed and fretted musical instrument comprising:

a keyboard;

a plurality of reciprocable buttons mounted on said keyboard in rows adjacent the frets of the musical instrument, each of said buttons having a shaft overlying one of the strings of the instrument; and a plurality of longitudinally extending reciprocable bar keys on said keyboard having opposite ends in contact with a button in adjacent ones of said rows of buttons on said keyboard.

2. The chord locater of claim 1 wherein each of said buttons has a head provided with shoulders along opposite edges for supporting the end of a bar key.

3. The chord locater of claim 2 wherein said keyboard is hollow and includes an upper and lower substantially planar surface having alinged holes receiving the heads and shafts on each of said buttons, and a coil spring wound about the shaft of each of said buttons between said head and lower planar surface of said keyboard.

4. The chord locater of claim 3 wherein said bar keys include a depending shaft integral therewith, a pin on the end of said bar key shaft extending perpendicular to the longitudinal axis of said bar key shaft below said lower planar surface, and a coil spring wound about said bar key shaft between said pin and lower planar surface.

5. The chord locater of claim 4 wherein said bar key shaft is shorter than each of said button shafts.

6. The chord locater of claim 5 wherein each of said button shafts includes a retaining pin extending perpendicular to the longitudinal axis of said shaft below said lower planar surface.

7. The chord locater of claim 6 wherein the terminal end of each of said button shafts includes a substantially V-shaped groove straddling said string.

* * * * *